United States Patent [19]

Bonin

[11] 4,408,590

[45] Oct. 11, 1983

[54] FUEL INJECTION PUMP

[75] Inventor: Jean-Claude Bonin, Blois, France

[73] Assignee: CAV Rotodiesel, Blois, France

[21] Appl. No.: 122,835

[22] Filed: Feb. 20, 1980

[30] Foreign Application Priority Data

Feb. 28, 1979 [FR] France ..... 79 05146

[51] Int. Cl.[3] ..... F02D 1/16

[52] U.S. Cl. ..... 123/502; 123/501

[58] Field of Search ..... 123/502, 501; 417/462

[56] References Cited

U.S. PATENT DOCUMENTS

| | | | |
|---|---|---|---|
| 4,041,919 | 8/1977 | Bonin | 123/502 |
| 4,122,813 | 10/1978 | Barnert et al. | 123/502 |
| 4,177,775 | 12/1979 | Hofer et al. | 123/502 |
| 4,214,564 | 7/1980 | Skinner | 123/502 |
| 4,224,916 | 9/1980 | Davis | 123/502 |
| 4,262,645 | 4/1981 | Kobayashi et al. | 123/502 |

FOREIGN PATENT DOCUMENTS

| | | | |
|---|---|---|---|
| 2345724 | 3/1974 | Fed. Rep. of Germany | 123/502 |
| 2620520 | 12/1977 | Fed. Rep. of Germany | 123/502 |
| 2641445 | 3/1978 | Fed. Rep. of Germany | 123/501 |

*Primary Examiner*—Charles J. Myhre
*Assistant Examiner*—Magdalen Moy
*Attorney, Agent, or Firm*—Holman & Stern

[57] ABSTRACT

A fuel injection pump for internal combustion engine, of the type comprising a body, a rotary distributor mounted in the body, driven in timed relationship with the associated engine, at least one pumping member carried by the rotary distributor, an angularly movable ring surrounding the rotary distributor, means provided on the ring to move the pumping member thereby to effect injection of fuel as the rotary distributor rotates, a piston coupled to the ring and slidably mounted with respect to the body, which piston is subjected to a fluid pressure which varies with the speed of the engine, and a spring bearing on the body and arranged to oppose the movement of the piston under the action of said pressure, wherein there is a cup-shaped member interposed between the spring and the piston, a rod comprising a retaining surface for defining the end position of the cup, the rod being slidable with respect to the body, and an actuating member for defining the axial position of the rod.

6 Claims, 6 Drawing Figures

FUEL INJECTION PUMP

Figure 1:
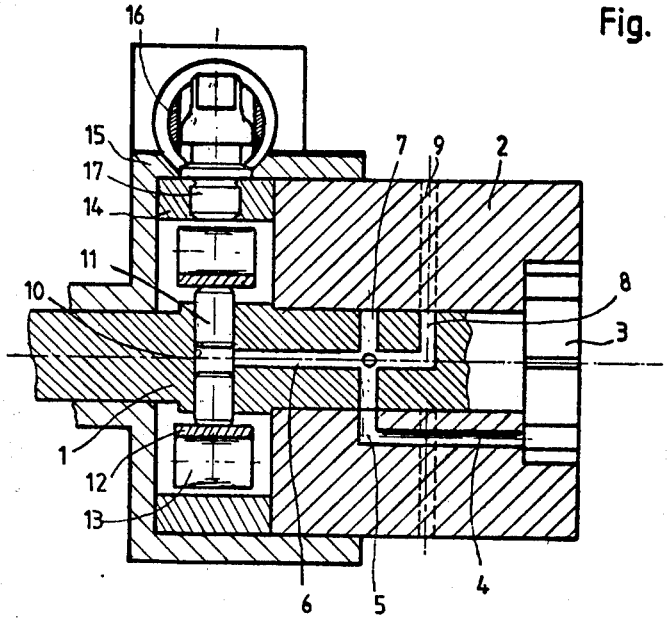

The present invention relates to a fuel injection pump of the rotary distributor type intended for supplying fuel to internal combustion engines, particularly Diesel engines.

Injection pumps of the rotary distributor type comprise, whatever the number of cylinders of the associated engine, a single pumping member (or a single group of a plurality of pumping members) and a rotary distributor which rotates within a fixed body. A ring is disposed around the rotary distributor, which either comprises lobes on its inner periphery which are engaged, as the rotary distributor rotates, by rollers carried by the pumping member to move the latter so as to effect injection of fuel into the engine or, reversely, carries rollers which are engaged by cam lobes carried by the pumping element.

The timing of injection is generally adjustable due to the fact that the ring is angularly displaceable with respect to the body of the pump. In this type of pump, the angular setting of the ring is effected, as is well known, by a piston slidably mounted in a bore in the body and mechanically coupled to the ring, which piston is subjected to the action of a fluid pressure and to the action, in opposite direction, of a spring bearing on the pump body.

This arrangement is usually used to vary the timing of injection in accordance with the speed of the engine, the pressure acting on the piston varying with the speed of the engine.

However, the setting of the ring as a function simply of the speed of the engine is insufficient to obtain a satisfactory operation of the engine, as it is often necessary, at low speeds of the engine, to adjust the timing of injection as a function of other parameters.

Thus, at low speeds, the timing of injection must be advanced when the engine is cold, or when running—in.

This therefore implies that the initial position of the ring may be modified.

French Patent Application Nr. 2 374 515 discloses a pump in which the initial position of the piston coupled to the ring may be altered in order to advance the timing of injection. However, such a device has a drawback in that, when the piston has been displaced in this way, the timing of injection is advanced over the whole range of the low speeds, i.e. from zero to the speed corresponding to a pressure sufficient to overcome the force of the spring, which may be prejudicial at starting.

In addition, a system of this type is incompatible with the so-called devices with automatic delay at start, as disclosed in French Patent Application Nr. 2 299 514, wherein the piston must be free and apt to occupy various positions as a function of various parameters. This incompatibility is due to the fact that the two initial settings of the ring are obtained by acting directly on the piston.

The object of the invention is therefore to provide an injection pump in which the timing of injection may be varied at low speeds of the engine without being modified on starting.

To this end, in the injection pump according to the invention, there is provided a cup-shaped member interposed between the spring and the piston, a rod comprising a retaining surface to define the end position of the cup-shaped member, the rod being slidable with respect to the body, and an actuating member for defining the axial position of the rod.

In the pump according to the invention, it is possible by altering the position of the rod, to modify the initial setting of the ring whilst enabling the piston to occupy an independent position on starting.

Figure 5:
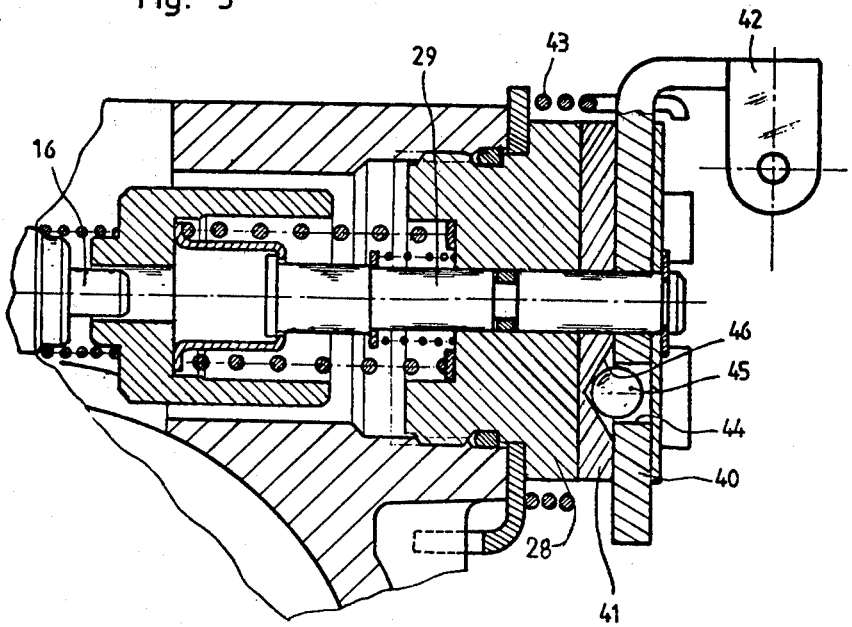
Figure 2:
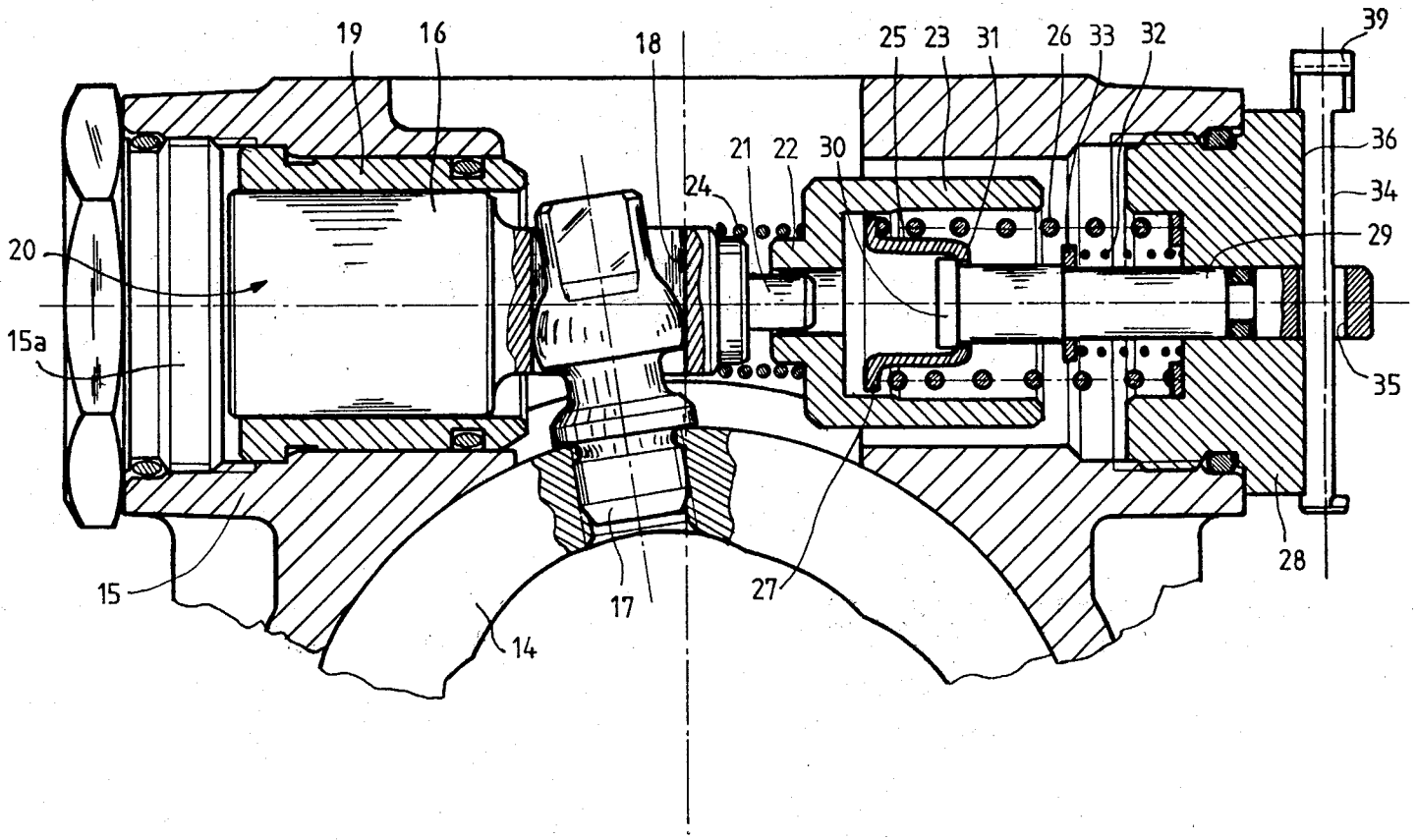
Figure 3A:
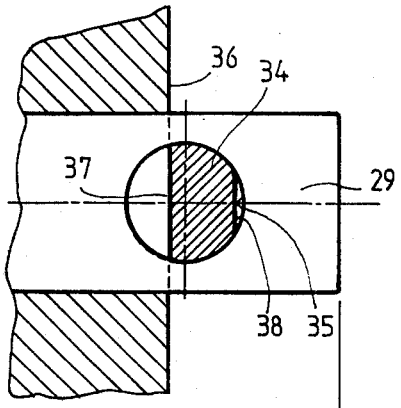
Figure 3B:
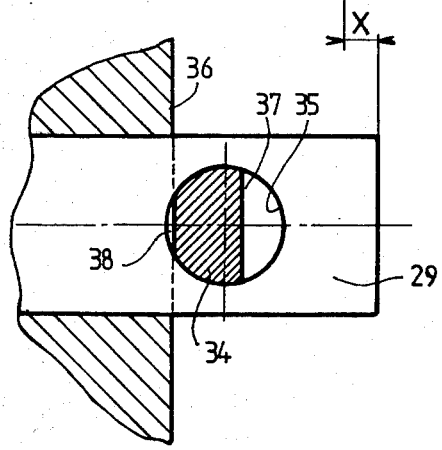
Figure 4:
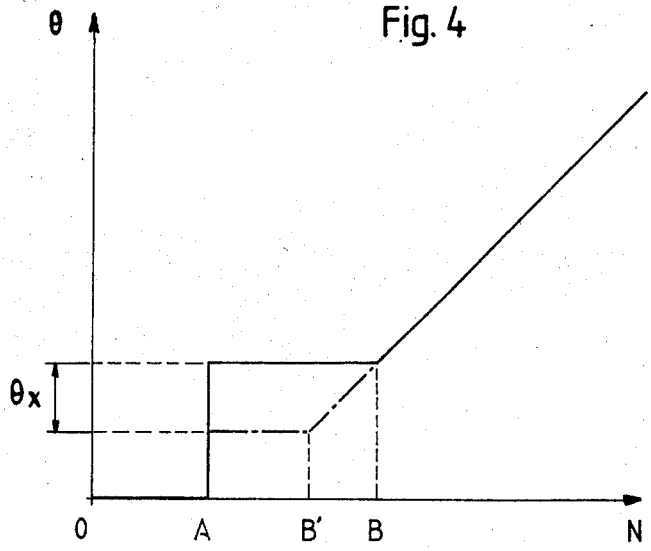

The invention will be more readily understood on reading the following description with reference to the accompanying drawings, in which:

FIG. 1 is a schematic axial section of a fuel injection pump of the rotary distributor type, FIG. 2 is a view in detail of the arrangement according to the invention for adjusting the timing of injection, in a first embodiment, FIGS. 3*a* and 3*b* illustrate the two possible adjustments with the arrangement of FIG. 2, FIG. 4 shows the variation of the timing of injection as a function of the speed of the engine, for the above two adjustments, and FIG. 5 shows a variant embodiment with respect to the arrangement of FIG. 2.

Referring now to the drawings, FIG. 1 shows a fuel injection pump which comprises a rotary distributor 1 mounted in a fixed body 2 and driven in timed relationship with the engine which is to be supplied with fuel. The rotary distributor 1 is coupled at one end to the rotary part of a feed pump 3 the outlet of which 4 is connected via a metering member (not shown) to an inlet port 5 which opens out on the periphery of the rotary distributor. The outlet pressure of the feed pump 3 is regulated by a valve (not shown) so as to vary in accordance with the speed of the engine.

The rotary distributor 1 comprises an axially extending passage 6 which communicates with a plurality of equi-angularly distributed inlet passages 7 formed in the rotary distributor, which are brought in register, in turn, with the inlet port 5 as the rotary distributor rotates. The axially extending passage 6 communicates, on the other hand, with an outlet passage 8 of which the opening on the periphery of the rotary distributor is brought in register in turn, as the rotary distributor rotates, with a plurality of outlets 9 formed in the fixed body 2 and each connected to an injection nozzle of the associated engine.

The axially extending passage 6 communicates, at its end, with a transverse bore 10 formed in the rotary distributor, which receives a pair of opposing pistons 11 which define a pumping chamber therebetween.

The pistons 11 are in contact, at their outer end, with shoes 12 bearing rollers 13. A ring 14 surrounding the rotary distributor presents on its inner periphery cam lobes with which the rollers 13 come into contact as the rotary distributor rotates, this effecting an inward movement of the pistons 11, and therefore the displacement of the fuel present in the pumping chamber in the direction of the outlet passage 8.

The ring 14 is angularly movable with respect to a part 15 of the pump body, and its angular setting is controlled by a piston 16 connected to a peg 17 fixed to the ring 14. The piston 16 is subjected to the action of a control pressure which is derived from the outlet pressure of the feed pump 3, so that the setting of the ring 14 varies in accordance with the speed of the engine. As is desirable, this makes it possible to advance the timing of injection as the speed of the engine increases.

The pump described up to now is quite conventional and the device for adjusting the timing of injection, forming the subject matter of the present invention, will now be described in detail.

A first embodiment of this device is shown in FIG. 2. The piston 16 is connected to the ring 14 by the peg 17 screwed in the ring and whose opposite end passes through a recess 18 made in the piston 16. The piston 16 is slidable in a bore defined by a sleeve 19 fixed to the part 15 of the pump body.

The face of the end 20 of the piston is subjected to the action of the above-mentioned control pressure varying with the speed of the engine, the connection provided to this end not being shown. The piston 16 comprises at its other end a lug 21 engaged in a narrow part 22 of a hollow intermediate piston 23, and a spring 24 is mounted between the piston 16 and the intermediate piston 23 and urges the piston 16 against a plug 15*a* closing the part 15.

In the wide part of the piston 23 is housed a cup-shaped member 25, and a spring 26 is mounted between the radial flange 27 of the cup and a plug 28 which closes the part 15 of the body.

In the plug 28 is slidably mounted a rod 29 terminating in a flange 30 which engages the inner flange 31 of the cup 25. A small spring 32 is mounted inside the spring 26 between the plug 28 and a washer 33 in abutment on a shoulder of the rod 29, this spring 32 thus acting to return the rod 29 in the direction of arrow F (towards the left in the drawing).

The axial position of the rod 29 with respect to the plug 28 may be modified by means of a pin 34 which passes through a bore 35 in the rod 29. The position of the rod 29, which is returned by the spring 32, is defined by the engagement of the pin 34 with the face 36 of the plug 28. The pin 34 comprises two flat portions 37 and 38 of different depths, which may be more readily seen in FIGS. 3*a* and 3*b*. In addition, an actuating member (not shown) is secured to the end 39 of the pin to rotate the same.

FIGS. 3*a* and 3*b* show that the position of the rod 29 with respect to the plug 28 may be modified by rotating the pin 34, since it depends on the distance between the flat portion in contact with the face 36 of the stopper and the axis of the pin 34. When the deeper flat portion 37 is in engagement with the face 36 (FIG. 3*a*), the penetration of the rod 29 inside the plug is larger than when the shallower flat portion 38 is in abutment on the face 36, as shown in FIGS. 2 and 3*b*. The difference X between the two settings is, of course, equal to the difference between the distances of the flat portions 37 and 38 to the axis of the pin 34.

The device operates as follows:

When the engine is at rest, or for very low speeds occurring on starting, the piston 16 is urged by the spring 24 into contact with the plug 15*a*, as the pressure acting on the face 20, which depends on the speed of the engine, is too low to compress the spring 24. This state corresponds to the section OA of the solid line graph of FIG. 4, in which the angular position $\theta$ of the ring 14 bound with that of the piston 16, is on the y-axis and the speed of the engine N is on the x-axis.

After starting, for example when the engine is idling, the pressure acting on the face 20 of the piston is sufficient to compress the spring 24, but too weak to compress the spring 26.

The piston 16 is then in abutment on the flange 27 of the cup 25 via the hollow piston 23, and the cup 25 is itself urged by the spring 26 into contact with the flange 30 of the rod 29. The position of the piston 16 with respect to the body of the pump, therefore the angular position of the ring 14, is then determined by the position of the rod 29 with respect to the plug 28 fixed to the body of the pump. The solid line graph of FIG. 4 corresponds to the position of the rod 29 shown in FIG. 2 and FIG. 3*b*, whilst the dashed and dotted graph with a section AB' corresponds to the position shown in FIG. 3*a*, where the rod 29 is driven in more.

The difference between the corresponding positions of the ring 14 is marked by $\theta_x$ in FIG. 4, and results from the above-mentioned difference between the two possible positions for the rod 29.

When the speed of the engine increases, the pressure acting on the piston 16 increases and becomes sufficient to compress the spring 26. The position of the piston 16 and therefore that of the ring 14 then vary in accordance with the speed of the engine so as to increase the advance.

In summary, it is observed that the arrangement of the invention allows an adjustment of the position of the ring 14 at low speeds (section AB or AB') compatible with the provision of a delay at starting (section OA).

FIG. 5 shows a modified embodiment of the device for adjusting the rod 29. The rod 29 is displaceable in translation with a plate 40 which may be displaced angularly with respect to the plug 28 by means of a lever 42 and which is urged in rotation by a torsion spring 43 in abutment on the pump body. Between the plate 40 and the plug is mounted a second plate 41 rotatable with the plug 28. The plate 40 comprises bores 44 each receiving a ball 45, whilst the face of the plate 41 facing the plate 40 is provided with recesses 46, advantageously conical in form.

When the relative angular position of the plates 40 and 41 is such as shown in FIG. 5, the recesses 46 being opposite the bores 44, the balls 45 are free in the recesses 46 and the plates 40 and 41 are in contact. This defines a first position for the rod 29.

When the plate 40 is rotated, the balls 45 leave the recesses 46 and displace the plate 40 outwardly. After a sufficient angular displacement of the plate 40, the balls 45 come in abutment on the face of the plate 41, this defining a second position for the rod 29, corresponding to an advance of the timing of injection.

The invention has been described in the case of the ring presenting cam lobes engaged by rollers carried by the pumping member, but it is clear that the invention is just as applicable to the opposite case of the ring carrying rollers which are engaged by cam lobes carried by the pumping member.

What I claim is:

1. In a fuel injection pump for an internal combustion engine of the type comprising a body, a rotary distributor mounted in the body, driven in timed relationship with the associated engine, at least one pumping member carried by the rotary distributor, an angularly movable ring surrounding the rotary distributor, means provided on the ring to move the pumping member thereby to effect injection of fuel as the rotary distributor rotates, the piston means coupled to the ring and slidably mounted with respect to the body, said piston means being subjected on a first end face to a fluid pressure acting between said first end face and a first part of the body and varying with the speed of the engine, and on a second end face opposed to said first end face to spring means bearing on a second part of the body and acting to oppose the movement of said piston means under the action of said fluid pressure, the improvement comprising:

a rod slidably mounted in said second part of the body, a cup-shaped member facing said second end face of the piston means and slidably mounted on said rod, said spring means urging said member towards said second end face, whereby said cup-shaped member comes into contact with said second end face when said piston means is urged by the fluid pressure towards said second part of the body, and an actuating member for defining the axial position of said rod.

2. The pump according to claim 1, wherein the rod engages the actuating member by one end which extends from the pump body and is urged in the direction opposite said end by said spring means.

3. A pump according to claim 2, wherein the actuating member is a pin which passes through a transverse cylindrical bore formed in the rod, the pin presenting two opposite flat portions of different depths adapted for engagement with the body and being rotatable about its axis.

4. A pump according to claim 2, wherein the actuating member is an angularly movable plate fast with the rod, which comprises bores receiving balls, which plate is resiliently urged against a second plate restrained for rotation and provided with recesses adapted to be placed in register with said bores.

5. A pump according to claim 4, wherein the recesses are conical.

6. The pump of claim 1 wherein the rod includes stop means disposed thereon to limit the movement of said cup-shaped member towards said second end face.

* * * * *